US008573386B2

(12) United States Patent
Sikora et al.

(10) Patent No.: US 8,573,386 B2
(45) Date of Patent: Nov. 5, 2013

(54) SYSTEM OF DEVICES FOR TRANSPORTING ROD SHAPED ELEMENTS IN PRODUCTION ARRANGEMENT OF TOBACCO INDUSTRY

(75) Inventors: Leszek Sikora, Radom (PL); Radoslaw Owczarek, Radom (PL); Adam Gielniewski, Radom (PL); Marek Warchol, Pionki (PL); Kazimierz Makosa, Pionki (PL)

(73) Assignee: International Tobacco Machinery Poland Sp. Z O.O., Radom (PL)

( * ) Notice: Subject to any disclaimer, the term of this patent is extended or adjusted under 35 U.S.C. 154(b) by 181 days.

(21) Appl. No.: 12/991,068

(22) PCT Filed: May 27, 2009

(86) PCT No.: PCT/PL2009/000056
§ 371 (c)(1),
(2), (4) Date: Nov. 4, 2010

(87) PCT Pub. No.: WO2009/145650
PCT Pub. Date: Dec. 3, 2009

(65) Prior Publication Data

US 2011/0056801 A1 Mar. 10, 2011

(30) Foreign Application Priority Data

May 29, 2008 (PL) ..... 385298

(51) Int. Cl.
*A24C 5/352* (2006.01)
*B65G 37/00* (2006.01)

(52) U.S. Cl.
USPC ..... 198/601

(58) Field of Classification Search
USPC ..... 198/374.1, 358
See application file for complete search history.

(56) References Cited

U.S. PATENT DOCUMENTS 3,799,324 A * 3/1974 Hall ..... 198/347.1
3,923,173 A * 12/1975 Schubert ..... 414/404

(Continued)

FOREIGN PATENT DOCUMENTS

EP 1752053 A1 2/2007
GB 1209745 A 10/1970
GB 2178390 A 2/1987

OTHER PUBLICATIONS

International Search Report of PCT/PL2009/000056, mailing date Sep. 24, 2009.

(Continued)

*Primary Examiner* — Gene Crawford
*Assistant Examiner* — Lester Rushin
(74) *Attorney, Agent, or Firm* — Westerman, Hattori, Daniels & Adrian, LLP

(57) ABSTRACT

System having a transitory store (S), in the inlet zone (5) of which, there are disposed fillers (4) for compartment trays, to which rod shaped elements are delivered by in-feed conveyors (3) in form of mass flow from making machines (1), and each machine is assigned with a separate filler (4). In the outlet zone (9) of the store (S) there are disposed unloaders (8) for said trays, and rod shaped elements are delivered by out-feed conveyors (10) in form of mass flow to processing machines (2), and each machine (2) is assigned with a separate unloader (8). On the trajectory of each out-feed conveyor (10) there is situated an emptying hopper (11) co-operating with a mobile filler (12) for compartment trays. Moreover in the inlet zone (5) of the store (S) there is situated a filler (4') for compartment trays, connected to an unloader (6) for one chamber trays with an in-feed conveyor (3'), and an in-feed conveyor (14), and in the outlet zone (9) there is situated an out-feed conveyor (15).

2 Claims, 1 Drawing Sheet

(56) References Cited

U.S. PATENT DOCUMENTS

| | | | | |
|---|---|---|---|---|
| 4,339,026 | A * | 7/1982 | Base et al. | 198/347.3 |
| 4,595,025 | A | 6/1986 | Wahle et al. | |
| 4,865,179 | A * | 9/1989 | Carter et al. | 198/347.2 |
| 5,628,162 | A | 5/1997 | Kreusch et al. | |
| 6,158,194 | A | 12/2000 | Horn et al. | |
| 6,193,051 | B1 * | 2/2001 | Focke | 198/347.3 |
| 2007/0034217 | A1 | 2/2007 | Spatafora | |
| 2011/0058924 | A1 * | 3/2011 | Sikora et al. | 414/403 |

OTHER PUBLICATIONS

Written Opinion of PCT/PL2009/000056, mailing date Sep. 24, 2009.

* cited by examiner

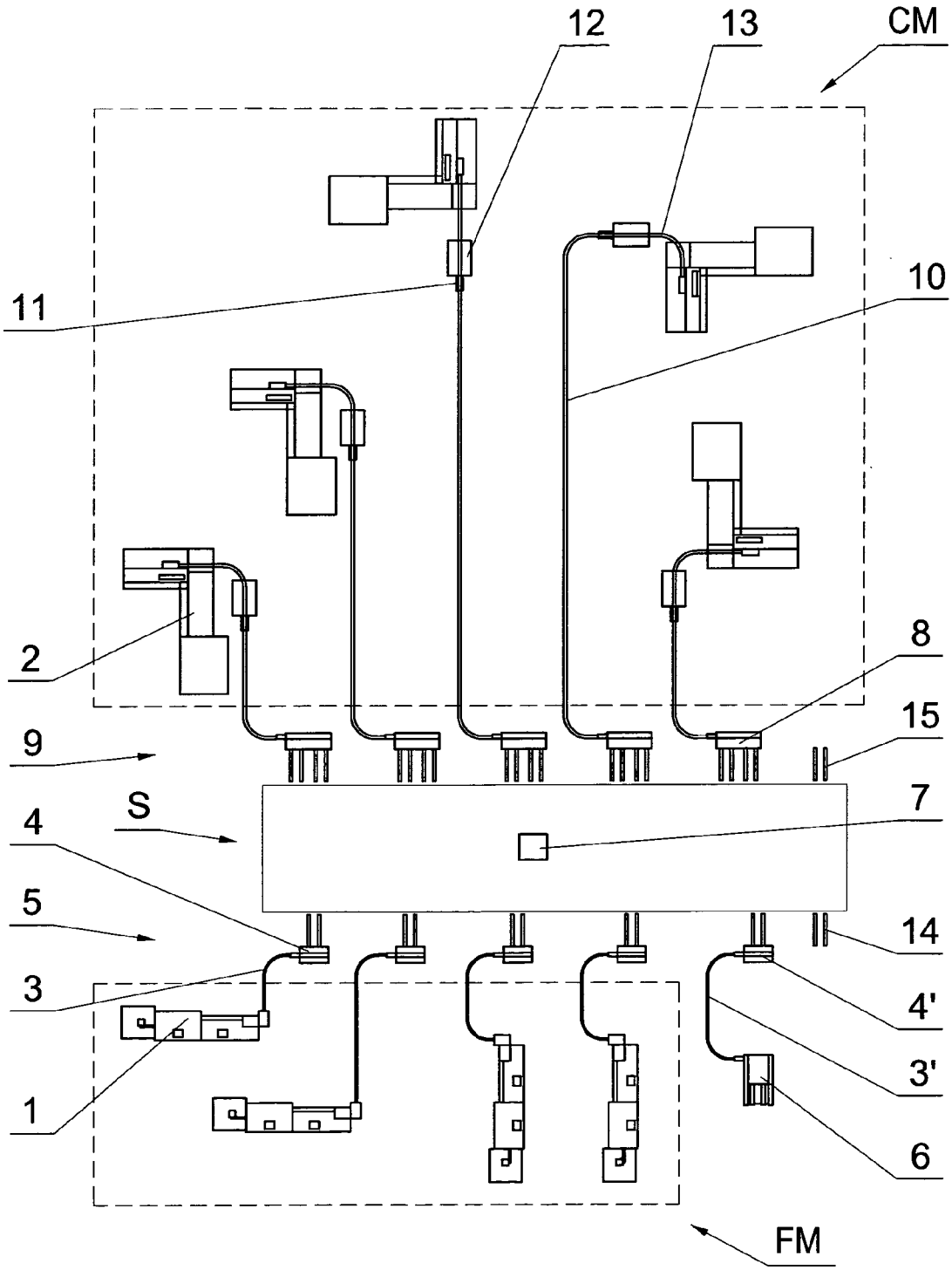
12
13
CM
11
10
2
8
15
9
S
7
4
5
14
3
4'
3'
1
6
FM

SYSTEM OF DEVICES FOR TRANSPORTING ROD SHAPED ELEMENTS IN PRODUCTION ARRANGEMENT OF TOBACCO INDUSTRY

FIELD OF THE INVENTION

The subject of the invention is a system of devices for transporting rod shaped elements in production arrangement of tobacco industry between machines making elements and machines processing elements in further operations with use of a transitory store, whereas rod shaped elements, especially filter rods, are delivered to the transitory store in trays.

BACKGROUND OF THE INVENTION

In production of rod shaped elements of tobacco industry there is a necessity of transporting the elements from making machines to machines effecting further operations on them. The more diversified is the assortment of products manufactured, which causes the number of making and processing machines to be increased, the more complicated is the system of production arrangement, for various types of manufactured elements must be delivered at a certain moment to respective processing machines. Said elements, after manufacturing, are loaded into one chamber trays and then are brought into an intermediate store, from where they are transferred for further processing. From British patent description No. GB 1 234 776 it is known a system of devices, applied in factories, for transporting cigarettes loaded in one chamber trays from making machines to an intermediate store, whereas the trays are transported in baskets and before bringing the trays into the store, the trays are unloaded from the baskets. The intermediate store is provided with several independent tray unloaders, which unload assortment defined trays and cigarettes are transferred in form of mass flow to a respective groups of packing machines. Another arrangement for making and packing cigarettes has been presented in U.S. Pat. No. 5,628,162. According to the invention, a group of cigarette making machines is connected to a group of packing machines by way of traction with use of a transporter transferring trolleys with containers in which there are stacked one chamber trays, whereas cigarettes are loaded into trays on making machines, next trays are grouped in containers in a special handling device and then the containers are transferred to the trolleys. The loaded trolleys may be kept in a specified store, from where they are collected at a certain moment to a transporter which transfers them to a respective packing machine, which is also provided with a special handling device for unloading containers and transferring full trays to a packing machine, and, after emptying them, for grouping empty trays in containers and placing containers on a trolley, which is taken back to the traction transporter. From another U.S. Pat. No. 6,158,194 it is known a system for transporting rod shaped elements collected in one chamber trays in tobacco industry, especially filters, where the production line consists of a group of making machines and a group of machines for further processing the elements. The produced rod shaped elements are charged into one chamber trays in form of a cubicoid devoid of the top and one side wall, in a tray filler associated with a making machine, and then trays of one assortment of product are transferred to a special device for handling containers, where they are stacked in containers. Next the closed containers are displaced to an intermediate store comprising a significant number of stationary shelving, on which containers with full trays are positioned with use of a stacking machine which moves along the shelving. After receiving a signal the stacking machine removes a respective container off the shelving and passes it to a special handling device disposed in the zone of a production line comprising machines for processing elements, where trays are removed from a container and transferred to an unloader to empty rod shaped elements, which are then used in a processing machine. In a system according to the invention it has been ensured to facilitate direct transferring containers between handling devices located in the zone of making machines and in the zone of processing machines. Empty trays are stacked back into the container in a special handling device of the zone of processing machines, and then the container is collected by the stacking machine and located on the shelving in the zone for empty trays. After receiving a signal the stacking machine delivers a container with empty trays to a specified handling device of the zone of making machines.

SUMMARY OF THE INVENTION

The object of the invention is a new system of production arrangement of tobacco industry, in which there is used mass flow on out-feed conveyors for collecting rod shaped elements from machines making said elements and for delivering said elements to processing machines, as well as transport in trays in order to temporarily store rod shaped elements, whereas the production arrangement, due to a suitable configuration of devices, enables handling a plurality of various assortments of rod shaped elements being produced simultaneously. It can be assumed that majority of temporary production arrangements of tobacco industry consists of a sector comprising machines making rod shaped elements and a sector comprising machines for processing said elements, whereas between the sectors there is a transitory store, in which rod shaped elements are stored in trays.

According to the invention, in an inlet zone of a transitory store there are situated fillers for compartment trays, to which rod shaped elements are delivered by in-feed conveyors in form of mass flow from making machines, whereas each making machine is assigned with a separate filler. In an outlet zone of the transitory store there are situated unloaders for compartment trays, from which rod shaped elements are delivered by out-feed conveyors in form of mass flow to processing machines, whereas each making machine is assigned with a separate unloader. On the trajectory of each out-feed conveyor there is situated an emptying hopper cooperating with a mobile filler for compartment trays. The production arrangement comprises at least one mobile filler for compartment trays. An out-feed conveyor in its end segment between an emptying hopper and a processing machine may move also towards the emptying hopper. Moreover in the inlet zone of the transitory store there is situated a filler for compartment trays connected to an unloader for one chamber trays with an in-feed conveyor. The production arrangement comprises at least one filler for compartment trays for rod shaped elements delivered in form of mass flow by an in-feed conveyor from an unloader for one chamber trays, whereas each said filler is connected to one tray unloader for one chamber trays. In the inlet zone of the transitory store there may be situated at least one, in-feed conveyor and in the outlet zone of said transitory store there may be situated at least one out-feed conveyor. The presented system makes it possible to use completely rod shaped elements located on the out-feed conveyor in case of changing production profile, and as a result it enables frequent assortment changes depending on the demand. Moreover it enables bringing in the arrangement rod shaped elements manufactured in another system and delivered in trays which are not acceptable in said arrangement, which enables increasing flexibility of production profile changes in a very short time.

DETAILED DESCRIPTION OF THE INVENTION

The object of the invention is shown in an embodiment in the drawing, which presents a simplified scheme of production arrangement of tobacco industry. In the presented example of arrangement, in a sector FM there are situated machines 1 manufacturing rod shaped elements in form of filter rods, and in a sector CM there are situated various processing machines 2 like cigarette making machines, filter attachment machines, packing machines and others. Between the sectors FM and CM there is a transitory store S. The assortment of filter rods manufactured on each of the machines 1 is delivered in form of mass flow by out-feed conveyor 3 to a filler 4 for compartment trays, whereas all the fillers 4 are located in an inlet zone 5 of the transitory store S. Moreover in the inlet zone 5 there is situated at least one filler 4' for compartment trays connected to an unloader 6 for typical one chamber trays, carton trays or carton trays inserted into typical trays with an in-feed conveyor 3'. Filter rods, after placing in a compartment tray in filler 4, 4', are transferred to the transitory store S, where a stacking machine 7 places full trays on a programmed station, in order to deliver a full tray to a respective tray unloader 8 for compartment trays after a signal given by the control system, whereas all the unloaders 8 are situated in an outlet zone 9 of the transitory store S. The construction and the principle of operating of the tray unloader 8 for compartment trays has been presented in description of Polish invention being the property of the applicant, No, P-385300. After unloading a compartment tray filter rods are fed in form of mass flow by an out-feed conveyor 10 to a respective processing machine 2, where rods are the subject of further production operations. On the way of each out-feed conveyor 10, preferably in the vicinity of the processing machine 2, there is situated an emptying hopper 11, which can co-operate with a mobile filler 12 for compartment trays positioned under the hopper in case of necessity. The end segment 13 of the out-feed conveyor 10, between the emptying hopper 11 and the processing machine 2, may move also towards the emptying hopper 11. The production arrangement comprises at least one mobile filler 12 but the number of fillers 12 used depends mainly on the frequency of changes of assortment of produced filter rods. Moreover in the inlet zone 5 of the transitory store S there is disposed an in-feed conveyor 14, on which compartment trays are placed manually by an operator, and which enables bringing into the store S full and/or empty trays necessary for commencing automatic operation of the system or bringing into the store S trays which were previously withdrawn out of it or trays with rods removed from an out-feed conveyor 10 with use of a mobile filler 12. Similarly in the outlet zone 9 of the transitory store S there is situated an out-feed conveyor 15, from which compartment trays are collected manually by an operator, and which enables withdrawing trays from the store S, e.g. in case of ending of operating of the system or necessity of removing a certain assortment of products. The presented arrangement, in which there are isolated the inlet zone 5 and the outlet zone 9 situated in the vicinity of the transitory store S, is a simplest system. For spatial requirements enforced in tobacco industry the inlet zone 5 and the outlet zone 9 may be divided into subzones located e.g. alternately but they still constitute the inlet zone 5 and the outlet zone 9 according to the invention. Because of the same reasons the sectors FM and CM may be physically divided into subsectors.

Filter rods are manufactured in the sector FM on making machines 1, whereas on each machine 1 may be produced another type of filters. Filter rods produced in other systems and placed in typical one chamber trays are delivered to the unloader 6 disposed also in the sector FM. Filter rods transferred to the fillers 4 or 4' are placed in compartment trays, which having been coded are brought into the store S, whereas trays filled incorrectly or wrongly coded are removed.

FUNCTION DESCRIPTION OF THE INVENTION

For demand from a processing machine 2 a respective tray is collected from the store S and transferred to an unloader 8, and after unloading filter rods are displaced in form of mass flow on the out-feed conveyor 10 to the processing machine 2, whereas for organizational requirements of production arrangements the trajectory of the out-feed conveyor 10 has usually a considerable length. In case of necessity of change of production assortment on a certain processing machine 2, the out-feed conveyor 10 is stopped, and under the emptying hopper 11 there is located the mobile filler 12, in which into compartment trays are loaded filter rods resting on the out-feed conveyor 10 after starting the conveyor again. After filter rods have been removed from the conveyor 10 the drive of end segment 13 is switched on with reverse direction of movement and filter rods are removed into a compartment tray in the filler 12. Compartment trays filled correctly in the filler 12 are brought back into the store S in order to be used later. In case of complex production arrangement provided with a substantial number of processing machines 2, an appropriate number of mobile fillers 12 must be applied, whereas the in-feed conveyor 14 is started to fill the store S by an operator with full and empty trays before commencing automatic operation of the arrangement or in case of necessity of supplementing the stock of full and/or empty trays and in case of bringing again into the store the product assortment withdrawn previously out of it or removed from production with use of the mobile filler 12. Similarly the out-feed conveyor 15 is started to remove full trays and/or empty trays by an operator from the store S.

The invention claimed is:

1. A system for transporting rod shaped elements in production arrangement of tobacco industry between machines making elements and machines processing elements in further operations, provided with a transitory store, to which rod shaped elements are delivered in compartment trays, comprising:

a) a transitory store having an inlet zone that includes a plurality of fillers for compartment trays, to which rod shaped elements are mass-flow delivered by in-feed conveyors from making machines, wherein each making machine delivers to a separate one of said plurality of fillers, b) said transitory store further including an outlet zone having unloaders for unloading said compartment trays, c) said transitory store further including a stacking machine that places full compartment trays on a programmed station such as to deliver a full compartment tray to a respective one of said unloaders;

d) out-feed conveyors leading from said unloaders that mass-flow deliver the unloaded rod shaped elements to processing machines, wherein each unloader delivers to a separate processing machine, e) each out-feed conveyor having situated there-along, an emptying hopper cooperating with a mobile filler for said compartment trays, f) wherein an end segment of said out-feed conveyor between said emptying hopper and a processing machine is adapted to deliver said rod shaped elements towards the emptying hopper when production assortment is changed, g) wherein said inlet zone of the transitory store further includes at least one filler for compartment trays for rod shaped elements mass-flow delivered by an in-feed conveyor from an unloader for one chamber trays, wherein each said at least one filler is connected to one unloader for one chamber trays, and h) wherein in the inlet zone of the transitory store there is situated at least one in-feed conveyor on which compartment trays are placed manually by an operator and in the outlet zone of the transitory store there is situated at least one out-feed conveyor from which compartment trays are collected manually by an operator.

2. A method for transporting rod shaped elements in production arrangement of tobacco industry between machines making elements and machines processing elements in further operations, provided with a transitory store, to which rod shaped elements are delivered in compartment trays, comprising:

a) a transitory store having an inlet zone that includes a plurality of fillers for compartment trays, to which rod shaped elements are being mass-flow delivered by in-feed conveyors from making machines, each making machine delivering to a separate one of said plurality of fillers, b) said transitory store further including an outlet zone having unloaders for unloading said compartment trays, c) said transitory store further including a stacking machine placing full compartment trays on a programmed station to deliver a full compartment tray to a respective one of said unloaders;

d) out-feed conveyors leading from said unloaders that mass-flow delivering the unloaded rod shaped elements to processing machines, each unloader delivering to a separate processing machine, e) each out-feed conveyor having situated there-along an emptying hopper cooperating with a mobile filler for said compartment trays, f) an end segment of said out-feed conveyor between said emptying hopper and a processing machine delivering said rod shaped elements towards the emptying hopper when production assortment is changed, g) said inlet zone of the transitory store further includes at least one filler for compartment trays for rod shaped elements mass-flow delivering by an in-feed conveyor from an unloader for one chamber trays, wherein each said at least one filler is connected to one unloader for one chamber trays, and h) in the inlet zone of the transitory store at least one in-feed conveyor on which compartment trays are being placed manually by an operator and in the outlet zone of the transitory store at least one out-feed conveyor from which compartment trays are being collected manually by an operator.

* * * * *